US008127956B2

(12) United States Patent
Krotts et al.

(10) Patent No.: US 8,127,956 B2
(45) Date of Patent: Mar. 6, 2012

(54) COLLAPSIBLE STRUCTURE

(75) Inventors: Dean B. Krotts, Hartland, WI (US); Michael S. Kellogg, Oconomowoc, WI (US)

(73) Assignee: Bajer Design & Marketing, Inc., Waukesha, WI (US)

( * ) Notice: Subject to any disclaimer, the term of this patent is extended or adjusted under 35 U.S.C. 154(b) by 214 days.

(21) Appl. No.: 12/456,830

(22) Filed: Jun. 23, 2009

(65) Prior Publication Data

US 2009/0261094 A1 Oct. 22, 2009

Related U.S. Application Data

(63) Continuation-in-part of application No. 12/319,051, filed on Dec. 31, 2008, which is a continuation of application No. 11/063,091, filed on Feb. 22, 2005, now abandoned, which is a continuation-in-part of application No. 10/413,925, filed on Apr. 15, 2003, now Pat. No. 6,948,632, which is a continuation-in-part of application No. 09/834,437, filed on Apr. 13, 2001, now abandoned, which is a continuation-in-part of application No. 09/698,674, filed on Oct. 27, 2000, now Pat. No. 6,494,335, which is a continuation-in-part of application No. 09/393,956, filed on Sep. 10, 1999, now abandoned, which is a continuation of application No. 09/108,521, filed on Jul. 1, 1998, now Pat. No. 5,971,188.

(51) Int. Cl.
*B65D 25/28* (2006.01)

(52) U.S. Cl. ..... 220/9.4; 220/9.5; 220/764

(58) Field of Classification Search ..... 220/9.4, 220/9.2, 764, 763, 762, 9.3, 9.1, 755, 753
See application file for complete search history.

(56) References Cited

U.S. PATENT DOCUMENTS

| | | | | |
|---|---|---|---|---|
| 177,749 | A | | 3/1876 | Redden |
| 216,227 | A | | 6/1879 | Sedgwick |
| 217,362 | A | | 7/1879 | Gardner |
| 218,277 | A | | 8/1879 | Kilham |
| 251,325 | A | | 12/1881 | Walters |
| 288,654 | A | * | 11/1883 | Morse ..... 220/9.2 |
| 338,892 | A | | 3/1886 | Walker |
| 344,340 | A | | 6/1886 | Barrow |
| 356,301 | A | | 1/1887 | Belknap |
| 414,622 | A | | 11/1889 | Willits |
| 481,957 | A | | 9/1892 | Klank |
| 665,942 | A | | 1/1901 | Tabler |
| 929,430 | A | | 7/1909 | Hill |
| 945,918 | A | | 1/1910 | Crawford |

(Continued)

FOREIGN PATENT DOCUMENTS

DE 281680 8/1913

(Continued)

OTHER PUBLICATIONS

"Magic Maaze" Frongate Mail-Order Catalog, Summer 1995, p. 32.

(Continued)

*Primary Examiner* — Stephen Castellano
(74) *Attorney, Agent, or Firm* — Ryan Kromholz & Manion, S.C.

(57) ABSTRACT

A collapsible structure having an open top, a relatively rigid handle frame member, and a handle member used for ease in transporting goods, along with a method of collapsing same.

10 Claims, 6 Drawing Sheets

U.S. PATENT DOCUMENTS

| | | | |
|---|---|---|---|
| 975,745 | A | 11/1910 | Bower |
| 1,087,702 | A | 2/1914 | Van Patten |
| 1,135,892 | A | 4/1915 | Grosenbeck |
| 1,144,643 | A | 6/1915 | Elkins |
| 1,155,475 | A | 10/1915 | Fay |
| 1,167,497 | A | 1/1916 | Hayes |
| 1,180,574 | A | 4/1916 | Despot |
| 1,181,829 | A | 5/1916 | Bower |
| 1,206,618 | A | 11/1916 | Thrasher et al. |
| 1,251,560 | A | 1/1918 | Myskow |
| 1,263,294 | A | 4/1918 | Taylor |
| 1,308,268 | A | 7/1919 | Wagner et al. |
| 1,360,844 | A | 11/1920 | Williams |
| 1,394,007 | A | 10/1921 | Hall |
| 1,520,532 | A | 12/1924 | Clark |
| 1,538,260 | A | 5/1925 | Street et al. |
| 1,581,888 | A | 4/1926 | Thomas |
| 1,583,083 | A | 5/1926 | Macaraig |
| 1,640,083 | A | 8/1927 | Ladd |
| 1,647,679 | A | 11/1927 | Williams |
| 1,691,904 | A | 11/1928 | Gamble |
| 1,703,066 | A | 2/1929 | Horn |
| 1,832,715 | A | 11/1931 | London |
| 1,836,297 | A | 12/1931 | Vienna |
| 1,979,978 | A | 11/1934 | Martin |
| 1,994,235 | A | 3/1935 | Solomon |
| 1,999,424 | A | 4/1935 | Seitz |
| 2,009,035 | A | 7/1935 | Towers |
| 2,016,520 | A | 10/1935 | Short |
| 2,042,888 | A | 6/1936 | Flood |
| 2,057,942 | A | 10/1936 | Fay |
| 2,071,850 | A | 2/1937 | Miller |
| 2,115,308 | A | 4/1938 | Koch |
| 2,136,761 | A | 11/1938 | Simmons |
| 2,182,932 | A | 12/1939 | Sanford |
| 2,269,574 | A | 1/1942 | Benenfeld |
| 2,280,601 | A | 4/1942 | Otter |
| 2,295,584 | A | 9/1942 | Larson |
| 2,298,786 | A | 10/1942 | Dubofsky et al. |
| 2,361,743 | A | 10/1944 | Butler |
| 2,517,757 | A | 8/1950 | Alderstein |
| 2,544,074 | A | 3/1951 | Ernst et al. |
| 2,575,893 | A | 11/1951 | Seaman |
| 2,600,501 | A | 6/1952 | Higgs |
| 2,625,973 | A | 1/1953 | Weldon et al. |
| 2,639,819 | A | 5/1953 | Marks |
| 2,664,131 | A | 12/1953 | Miller |
| 2,710,084 | A | 6/1955 | Braverman |
| 2,721,099 | A | 10/1955 | Rupp |
| 2,724,537 | A | 11/1955 | Fehr |
| 2,746,582 | A | 5/1956 | Cart |
| 2,761,480 | A | 9/1956 | Tames |
| 2,767,757 | A | 10/1956 | Marder |
| 2,778,560 | A | 1/1957 | Pfeiffer |
| 2,780,402 | A | 2/1957 | Zucker et al. |
| 2,833,460 | A | 5/1958 | Votolato |
| 2,879,553 | A | 3/1959 | Keating |
| 2,958,357 | A | 11/1960 | Vorgan |
| 3,014,516 | A | 12/1961 | Mueller |
| 3,017,117 | A | 1/1962 | Klingler |
| 3,061,396 | A | 10/1962 | Hock |
| 3,126,933 | A | 3/1964 | Mason et al. |
| 3,160,307 | A | 12/1964 | Morrison |
| 3,233,644 | A | 2/1966 | Bono |
| 3,257,077 | A | 6/1966 | Corning |
| 3,260,396 | A | 7/1966 | Buch |
| 3,265,284 | A | 8/1966 | Tompkins |
| 3,310,089 | A | 3/1967 | Silverman |
| 3,354,924 | A | 11/1967 | Birrell et al. |
| 3,373,925 | A | 3/1968 | Gatward |
| 3,410,328 | A | 11/1968 | Sasai |
| D213,131 | S | 1/1969 | Hamilton |
| 3,434,589 | A | 3/1969 | Valtri et al. |
| 3,439,865 | A | 4/1969 | Port et al. |
| D215,846 | S | 11/1969 | Curtin et al. |
| 3,480,059 | A | 11/1969 | Schoening |
| 3,502,091 | A | 3/1970 | Corbin |
| 3,583,748 | A | 6/1971 | Arndt |
| 3,603,367 | A | 9/1971 | Lehrman |
| 3,661,326 | A | 5/1972 | Wilson |
| 3,675,667 | A | 7/1972 | Miller |
| 3,675,981 | A | 7/1972 | Mallander |
| 3,696,850 | A | 10/1972 | Rosenblum |
| 3,709,237 | A | 1/1973 | Smith |
| 3,727,786 | A | 4/1973 | Fausel |
| 3,732,978 | A | 5/1973 | Reader |
| 3,733,758 | A | 5/1973 | Maier et al. |
| 3,796,342 | A | 3/1974 | Sanders et al. |
| 3,799,384 | A | 3/1974 | Hurkamp |
| 3,807,421 | A | 4/1974 | Geiger et al. |
| 3,834,528 | A | 9/1974 | Pickford et al. |
| 3,843,222 | A | 10/1974 | Berkun |
| 3,868,155 | A | 2/1975 | Cherubini |
| 3,880,459 | A | 4/1975 | Kelley |
| 3,883,026 | A | 5/1975 | Selz |
| 3,893,649 | A | 7/1975 | Cornell et al. |
| 3,935,958 | A | 2/1976 | Frangos |
| 3,946,903 | A | 3/1976 | Parker |
| 3,955,706 | A | 5/1976 | Whitaker |
| 3,960,161 | A | 6/1976 | Norman |
| 3,987,580 | A | 10/1976 | Ausnit |
| 3,990,463 | A | 11/1976 | Norman |
| 4,010,784 | A | 3/1977 | Nattrass et al. |
| 4,011,611 | A | 3/1977 | Lederman |
| 4,055,239 | A | 10/1977 | Weiner |
| 4,073,105 | A | 2/1978 | Daugherty |
| 4,094,639 | A | 6/1978 | McMillan |
| 4,118,089 | A | 10/1978 | Johnson et al. |
| 4,133,149 | A | 1/1979 | Angress |
| 4,134,225 | A | 1/1979 | Welch |
| 4,165,757 | A | 8/1979 | Marks |
| 4,170,082 | A | 10/1979 | Freedman |
| 4,180,113 | A | 12/1979 | Liebling |
| 4,195,804 | A | 4/1980 | Hujsak et al. |
| 4,212,130 | A | 7/1980 | Walker |
| 4,212,377 | A | 7/1980 | Weinreb |
| 4,246,945 | A | 1/1981 | Sterling |
| 4,248,278 | A | 2/1981 | Blodgett |
| 4,248,442 | A | 2/1981 | Barrett |
| 4,265,261 | A | 5/1981 | Barker |
| 4,287,701 | A | 9/1981 | Washington |
| 4,299,365 | A | 11/1981 | Battle |
| 4,304,068 | A | 12/1981 | Beder |
| 4,313,634 | A | 2/1982 | Williams |
| 4,352,457 | A | 10/1982 | Weick |
| 4,388,739 | A | 6/1983 | Martinon et al. |
| 4,401,213 | A | 8/1983 | Lerner |
| D270,939 | S | 10/1983 | Stehlik |
| 4,411,300 | A | 10/1983 | Rico |
| 4,427,110 | A | 1/1984 | Shaw, Jr. |
| 4,428,484 | A | 1/1984 | Rattay et al. |
| D274,662 | S | 7/1984 | Fausel |
| 4,485,855 | A | 12/1984 | Dillingham |
| D279,249 | S | 6/1985 | Fausel |
| 4,580,776 | A | 4/1986 | Burkinshaw |
| 4,585,283 | A | 4/1986 | Redmon et al. |
| 4,603,432 | A | 7/1986 | Marino |
| 4,610,394 | A | 9/1986 | Bryson |
| 4,630,312 | A | 12/1986 | Milstein |
| 4,630,747 | A | 12/1986 | Chiang et al. |
| 4,632,138 | A | 12/1986 | Irwin |
| D288,019 | S | 1/1987 | Gebhard et al. |
| 4,635,411 | A | 1/1987 | Kurzen |
| 4,642,934 | A | 2/1987 | Carlson et al. |
| 4,646,802 | A | 3/1987 | Basore et al. |
| D290,538 | S | 6/1987 | Basore |
| 4,683,927 | A | 8/1987 | Pyzer |
| 4,697,357 | A | 10/1987 | Van Vliet |
| 4,706,845 | A | 11/1987 | Schnurer et al. |
| 4,715,572 | A | 12/1987 | Robbins, III et al. |
| 4,716,918 | A | 1/1988 | Hayashida et al. |
| 4,728,066 | A | 3/1988 | Lang et al. |
| 4,730,748 | A | 3/1988 | Bane |
| 4,738,478 | A | 4/1988 | Bean, Jr. |
| 4,747,701 | A | 5/1988 | Perkins |
| 4,752,008 | A | 6/1988 | Pratt |
| 4,759,518 | A | 7/1988 | Yardas |

4,779,794 A 10/1988 Moore
4,781,300 A 11/1988 Long
4,783,031 A 11/1988 Ebentheuer
4,784,248 A 11/1988 Workman
4,790,029 A 12/1988 LaFleur et al.
4,812,054 A 3/1989 Kirkendall
4,813,520 A 3/1989 Lin
4,815,784 A 3/1989 Zheng
4,825,892 A 5/1989 Norman
4,842,032 A 6/1989 Mastronardo
4,854,501 A 8/1989 Ricci
4,858,561 A 8/1989 Springer
4,858,634 A 8/1989 McLese
4,862,602 A 9/1989 Krill
4,876,829 A 10/1989 Mattick
4,895,230 A 1/1990 King
4,899,967 A 2/1990 Johnson
4,903,584 A 2/1990 Styles
4,925,102 A 5/1990 Jones et al.
4,940,200 A 7/1990 Sawyer et al.
4,946,118 A 8/1990 Hastings
4,948,077 A 8/1990 Gonzalez
4,951,333 A 8/1990 Kaiser et al.
4,953,815 A 9/1990 Beymer et al.
4,964,859 A 10/1990 Feldman
4,989,749 A 2/1991 Choi
4,995,487 A 2/1991 Plath
D315,432 S 3/1991 Smith
5,007,250 A 4/1991 Musielak
5,009,189 A 4/1991 Neff
5,011,008 A 4/1991 Baker
5,022,767 A 6/1991 Cardulla
5,024,262 A 6/1991 Huang
5,027,748 A 7/1991 Wolak
5,031,793 A 7/1991 Chen et al.
5,035,460 A 7/1991 Huang
5,036,999 A 8/1991 Bitsch
5,038,812 A 8/1991 Norman
5,054,507 A 10/1991 Sparks
5,072,828 A 12/1991 Irvine
5,082,219 A 1/1992 Blair
5,090,588 A 2/1992 Van Romer et al.
RE33,842 E 3/1992 Ebentheuer
5,116,138 A 5/1992 Mascenti et al.
5,118,201 A 6/1992 Cook
5,134,815 A 8/1992 Pickett
5,137,044 A 8/1992 Brady
5,143,283 A 9/1992 Lancaster
5,174,462 A 12/1992 Hames
5,195,649 A 3/1993 Wolters
5,213,147 A 5/1993 Zheng
5,222,513 A 6/1993 Hilliard
5,253,775 A 10/1993 Gould
5,263,672 A 11/1993 He
5,273,142 A 12/1993 Weber
5,301,705 A 4/1994 Zheng
5,324,490 A 6/1994 Van Vlahakis et al.
5,335,805 A 8/1994 Chen
5,343,887 A 9/1994 Danaher
5,356,024 A 10/1994 Ho et al.
5,358,440 A 10/1994 Zheng
5,375,267 A 12/1994 Davis
5,382,087 A 1/1995 Pouch
5,393,023 A 2/1995 Callan
5,394,897 A 3/1995 Ritchey et al.
5,411,046 A 5/1995 Wan
5,429,437 A 7/1995 Shaw et al.
5,437,384 A 8/1995 Farrell
5,437,410 A 8/1995 Babasade
5,449,083 A 9/1995 Dougherty et al.
5,464,113 A 11/1995 Ho et al.
5,467,794 A 11/1995 Zheng
5,468,061 A 11/1995 Friess et al.
5,472,280 A 12/1995 Rittmaster
5,474,196 A 12/1995 Fausel et al.
5,484,078 A 1/1996 Bronovicki
5,492,675 A 2/1996 Brizard
5,560,385 A 10/1996 Zheng
5,576,621 A 11/1996 Clements
5,593,046 A 1/1997 Katsuura et al.
5,620,069 A 4/1997 Hurwitz
5,664,596 A 9/1997 Zheng
5,664,886 A 9/1997 Hutchinson
5,671,479 A 9/1997 Dedrick
5,722,446 A 3/1998 Zheng
5,746,514 A 5/1998 Orensten
5,762,530 A 6/1998 Zheng
5,778,915 A 7/1998 Zheng
D397,756 S 9/1998 Hagerty
5,800,067 A 9/1998 Easter
5,816,279 A 10/1998 Zheng
5,816,954 A 10/1998 Zheng
5,827,104 A 10/1998 Zheng
5,845,697 A 12/1998 Zheng
5,853,313 A 12/1998 Zheng
D406,423 S 3/1999 Kellogg et al.
D407,765 S 4/1999 Zheng
5,901,926 A 5/1999 Zheng
5,906,290 A 5/1999 Haberkorn
5,910,038 A 6/1999 Zheng
5,910,058 A 6/1999 Zheng
5,927,793 A 7/1999 McGrath, Jr.
5,938,496 A 8/1999 Zheng
5,941,265 A 8/1999 Zheng
5,964,533 A 10/1999 Ziglar
5,967,357 A 10/1999 Kellogg et al.
5,971,188 A 10/1999 Kellogg et al.
5,971,410 A 10/1999 Niichols
5,975,101 A 11/1999 Zheng
5,992,045 A 11/1999 Kellogg et al.
5,992,676 A 11/1999 Tsai
6,006,772 A 12/1999 Zheng
6,059,912 A 5/2000 Kellogg et al.
6,088,953 A 7/2000 Morgan
6,089,394 A 7/2000 Ziglar
6,102,569 A 8/2000 Wang
D431,361 S 10/2000 Kellogg et al.
D433,810 S 11/2000 Kellogg et al.
D438,009 S 2/2001 Kellogg et al.
6,209,557 B1 4/2001 Zheng
6,220,998 B1 4/2001 Kellogg et al.
6,269,826 B1 8/2001 Zheng
D449,447 S 10/2001 Kellogg et al.
6,305,396 B1 10/2001 Zheng
6,311,709 B1 11/2001 Louie et al.
6,360,760 B1 3/2002 Louie et al.
6,363,955 B1 4/2002 Louie
6,390,111 B2 5/2002 Zheng
D461,638 S 8/2002 Kellogg et al.
RE37,924 E 12/2002 Kellogg et al.
6,494,335 B1 12/2002 Kellogg et al.
6,502,595 B2 1/2003 Louie
6,527,136 B1 3/2003 Sabounjian
6,585,414 B2 7/2003 Peska
6,702,119 B2 3/2004 Sabounjian
6,705,338 B2 3/2004 Zheng
D494,367 S 8/2004 Yang
RE38,591 E 9/2004 Kellogg et al.
6,874,797 B2 4/2005 Gardenour
6,948,632 B2 9/2005 Kellogg et al.
6,997,338 B2 * 2/2006 Sabounjian ..... 220/9.4
D519,280 S 4/2006 Kellogg et al.
7,066,647 B2 6/2006 Peska
7,077,147 B2 7/2006 Louie et al.
7,111,634 B2 9/2006 Louie
7,137,399 B1 11/2006 Ransom et al.
D536,872 S 2/2007 Kellogg et al.
7,178,538 B2 2/2007 Ransom
D547,950 S 8/2007 Kellogg et al.
D551,452 S 9/2007 Kellogg et al.
D555,854 S 11/2007 Kamiya
D555,905 S 11/2007 Kellogg et al.
D612,117 S 3/2010 Krotts et al.
7,673,770 B2 * 3/2010 Summerfield ..... 220/755
D622,960 S 9/2010 Sabounjian
2002/0112753 A1 8/2002 Louie
2003/0213511 A1 11/2003 Louie

| | | | |
|---|---|---|---|
| 2004/0129307 | A1 | 7/2004 | Louie et al. |
| 2006/0112621 | A1 | 6/2006 | White |
| 2007/0079548 | A1 | 4/2007 | Bakowski |

FOREIGN PATENT DOCUMENTS

| | | | |
|---|---|---|---|
| DE | 2015649 | | 2/1971 |
| DE | 30 13 178 | | 11/1981 |
| DE | 41 14 916 | | 11/1991 |
| FR | 589062 | | 5/1925 |
| FR | 1215335 | | 11/1959 |
| FR | 1380728 | | 12/1964 |
| FR | 1380738 | | 2/1990 |
| FR | 2635136 | | 2/1990 |
| GB | 1367 | | 0/1871 |
| GB | 5939 | | 0/1915 |
| GB | 140570 | | 4/1920 |
| GB | 2097244 | A | 11/1982 |
| GB | 2126535 | | 3/1984 |
| GB | 2212114 | | 7/1989 |
| JP | 6-42227 | | 2/1994 |

OTHER PUBLICATIONS

Playhut brochure, date unknown.
Eileen Edinger letter, dated May 25, 1993.
Eileen Edinger Douglas letter, dated Aug. 26, 1996.
Patent Application re: prior art product sold in U.S. by Stephen A. Fausel and Paul S. Ziglar; specification for Collapsible Furniture, Jun. 1985.
USPTO Office Action dated Oct. 10, 2000 regarding U.S. Appl. No. 09/574,757, 13 pages.
USPTO Office Action dated Apr. 7, 1999 regarding U.S. Appl. No. 09/108,521, 10 pages.
USPTO Office Action dated Mar. 22, 2000 regarding U.S. Appl. No. 09/393,956, 8 pages.
USPTO Office Action dated May 16, 2000 regarding U.S. Appl. No. 09/393,956, 7 pages.
USPTO Office Action dated Dec. 7, 2001 regarding U.S. Appl. No. 09/698,674, 33 pages.
USPTO Office Action dated Mar. 10, 2003 regarding U.S. Appl. No. 09/834,437, 5 pages.
USPTO Office Action dated Sep. 22, 2004 regarding U.S. Appl. No. 10/413,925, 5 pages.
USPTO Office Action dated Apr. 13, 2004 regarding U.S. Appl. No. 10/413,925, 6 pages.
USPTO Office Action dated Jul. 2, 2004 regarding U.S. Appl. No. 10/413,925, 6 pages.
USPTO Office Action dated Jun. 23, 1999 regarding U.S. Appl. No. 09/262,904, 10 pages.
USPTO Office Action dated Oct. 14, 1999 regarding U.S. Appl. No. 09/262,904, 10 pages.
USPTO Office Action dated Feb. 7, 2000 regarding U.S. Appl. No. 09/262,904, 11 pages.
USPTO Office Action dated Feb. 7, 2002 regarding U.S. Appl. No. 09/644,894, 10 pages.
USPTO Office Action dated Apr. 4, 2002 regarding U.S. Appl. No. 09/644,894, 5 pages.
USPTO Office Action dated Jul. 30, 2002 regarding U.S. Appl. No. 09/644,894, 2 pages.
USPTO Office Action dated Oct. 6, 1998 regarding U.S. Appl. No. 09/114,370, 7 pages.
USPTO Office Action dated Mar. 2, 1999 regarding U.S. Appl. No. 09/114,370, 4 pages.
USPTO Notice of Allowance dated Nov. 23, 1999 regarding U.S. Appl. No. 09/173,079 (incl. Ex. Amt. & Interview Summary), 6 pages.
USPTO Office Action dated May 25, 2000 regarding U.S. Appl. No. 29/102,936, 5 pages.
USPTO Office Action dated Jun. 25, 1998 regarding U.S. Appl. No. 08/714,556, 18 pages.
USPTO Office Action dated Jan. 11, 1999 regarding U.S. Appl. No. 08/714,556, 15 pages.
USPTO Office Action dated Jan. 3, 2006 regarding U.S. Appl. No. 10/422,393, 6 pages.
USPTO Office Action dated Aug. 23, 2005 regarding U.S. Appl. No. 10/422,393, 6 pages.
USPTO Office Action dated Jun. 28, 2004 regarding U.S. Appl. No. 10/422,393, 7 pages.
USPTO Office Action dated May 28, 2008 regarding U.S. Appl. No. 11/063,091, 9 pages.
USPTO Office Action dated May 22, 2006 regarding U.S. Appl. No. 11/201,033, 10 pages.
USPTO Office Action dated Oct. 13, 2006 regarding U.S. Appl. No. 11/201,033, 12 pages.
USPTO Office Action dated Jun. 3, 2009 regarding U.S. Appl. No. 12/001,862, 10 pages.

* cited by examiner

COLLAPSIBLE STRUCTURE

RELATED APPLICATIONS

This is a continuation-in-part patent application of U.S. patent application Ser. No. 12/319,051, filed 31 Dec. 2008, which is a continuation of U.S. patent application Ser. No. 11/063,091, filed 22 Feb. 2005, now abandoned, which is a continuation-in-part of U.S. patent application Ser. No. 10/413,925, filed 15 Apr. 2003, now U.S. Pat. No. 6,948,632, which is a continuation-in-part of U.S. patent application Ser. No. 09/834,437, filed 13 Apr. 2001, now abandoned, which is a continuation-in-part of U.S. patent application Ser. No. 09/698,674, filed 27 Oct. 2000, now U.S. Pat. No. 6,494,335, which is a continuation-in-part of U.S. patent application Ser. No. 09/393,956, filed 10 Sep. 1999, now abandoned, which is a continuation of U.S. patent application Ser. No. 09/108,521, filed 1 Jul. 1998, now U.S. Pat. No. 5,971,188.

BACKGROUND OF THE INVENTION

The present invention relates generally to collapsible structures and specifically to a collapsible structure having an attached rigid handle frame member, pivotable handle member, and method of using such a structure for transportation of items, and subsequent storage of the container.

Typically, the consumer transports goods such as grocery items by way of grocery baskets, carts, paper bags, or the like. While paper and plastic bags have been used for years, in today's increasingly "green" initiative-driven society, a push toward reusable and other sustainable products has created a need for alternative products. Further, regardless of the type of container supplied by a retailer for use while shopping, a consumer typically requires a take-home container in which to transport purchased goods to their designated location.

The present invention provides facile transport and storage of such goods, while further providing an attractive, reusable, easy to store collapsible structure. For example, the present invention may be used to transport goods purchased in a grocery store, or may also be used to store and transport toys or other objects. The present invention includes a collapsible framework to provide a defined structure while expanded, with the collapsible capability further providing compact storage and subsequent reuse. The present invention also includes a rigid, pivotable handle member.

Numerous devices are known in the art to provide effective transportation and storage of goods and other items, including the aforementioned plastic and paper bags, conventional shopping baskets, or reusable shopping caddies. Further known are shopping totes which include a rigid handle affixed to a flexible receptacle. Many of these devices are voluminous in either their expanded or collapsed states, or both, are difficult to fold or collapse, or are difficult to manipulate between their expanded and collapsed states. For example, the latter devices may require repeated insertion and removal of stiff stay members to maintain sidewall shape and prevent sidewall collapse. The repeated insertion and removal of the stay members is cumbersome and time consuming, with the added possibility of losing the stays. Therefore there is a need for a carrying and storage receptacle that is lightweight, easy to carry, able to retain its shape, while also being easily collapsible for facile storage and subsequent reuse.

While each of the mentioned known solutions serves a limited purpose, none combines the features of the present invention. The present invention provides a convenient, easy to manipulate, collapsible and reusable container, with means for maintaining side wall shape while expanded, and a pivotable rigid handle all for use in storing or transporting various goods or other objects.

SUMMARY OF THE INVENTION

The present invention relates generally to a collapsible structure with an open top, and specifically to a collapsible structure having a relatively rigid handle member and handle frame member, for ease in transporting goods, and a method of using the same.

According to the present invention, the foregoing and other advantages are obtained by providing a collapsible structure comprising a plurality of side panels, a plurality of end panels, and a floor panel forming an enclosure having an open top. In a preferred embodiment, at least two oppositely disposed side panels comprise a flexible continuous loop frame, a web of material, and an edging material. The edging envelops the frame and is coupled to the periphery of the web. As is described with regard to the side panels, the floor panel may also comprise a flexible continuous loop frame, a web of material, and an edging material; the edging material enveloping the frame and being coupled to the periphery of the web. The floor panel is attached to the bottom sides of each side panel and each end panel, thus forming the structure. A relatively rigid handle frame member is attached to the periphery of the open top by way of a handle frame edging material which envelopes the handle frame and is coupled to the periphery of the open top. Further, a handle member is preferably pivotally attached to the handle frame member and is adapted to rotate between an upright, operable position and a horizontal storage position for use when the container is collapsed.

In an alternative embodiment, the container may be provided with means for releasable attachment of the handle frame member to the periphery of the open top. Such releasable attachment means may include releasable tab members or other suitable means. The releasable attachment means is preferably coupled to the open top at predetermined positions along its periphery.

In yet another embodiment, the collapsible container may include both a handle frame edging to envelop and retain a portion of the handle frame to the open top, and means for releasable attachment to releasably retain a remaining portion of the handle frame to the open top periphery. As in the previously discussed embodiment, such means for releasable attachment may include releasable tab members or other suitable means. Similarly, a floor panel is attached to the bottom side of each side panel and each end panel, thus forming the structure. As in previously mentioned embodiments, a handle member is preferably pivotally attached to the handle frame member, which is adapted to rotate between an upright, operable position and a horizontal storage position for use when the container is collapsed.

In still another alternative embodiment, the structure may be in the form of a curvilinear collapsible structure that is axially-compressible. A curvilinear web panel comprises generally cylindrical structure which may be reduced in size through axial compression. As will be seen, the curvilinear shape preferably includes a supporting frame having a continuous coil body which is axially-compressible from an extended position having a first height, to a collapsed position having a second height, which is substantially less than the first height. In a preferred embodiment, the coil body possesses a resilient memory that biases the body to the extended position. The supporting frame is preferably positioned within an edging which envelops the frame and is coupled to a surface of the web panel.

In accordance with an aspect of the invention, and similarly to other discussed embodiments, the curvilinear collapsible structure includes at least one handle frame member which is attached to and encircles the open top periphery. As in the previously discussed embodiments, the relatively rigid handle member may be attached to the periphery of the open top by way of a handle frame edging material which envelopes the handle frame member and is attached to the periphery of the open top. As previously discussed, a handle member is preferably pivotally attached to the handle frame member, with the handle member being adapted to rotate between an upright, operable position and a horizontal storage position for use when the container is in a compressed position.

In an alternative embodiment of the curvilinear collapsible structure, the open top may be provided with means for releasable attachment of the handle frame to the periphery of the open top. As in previously mentioned embodiments, such releasable attachment means may include releasable tab members which are preferably coupled to the open top at predetermined positions along its periphery. Further, and similarly to other mentioned embodiments, the curvilinear collapsible structure may include both a handle frame edging to envelop and retain a portion of the handle frame to the open top periphery, and means for releasable attachment to releasably retain a remaining portion of the handle frame to the open top periphery. Such means for releasable attachment may include the releasable tab members mentioned previously. A handle member is preferably pivotally attached to the handle frame member, which is adapted to rotate between an upright, operable position and a horizontal storage position for use when the curvilinear collapsible structure is in the compressed position.

DESCRIPTION OF THE PREFERRED EMBODIMENT

Figure 1:
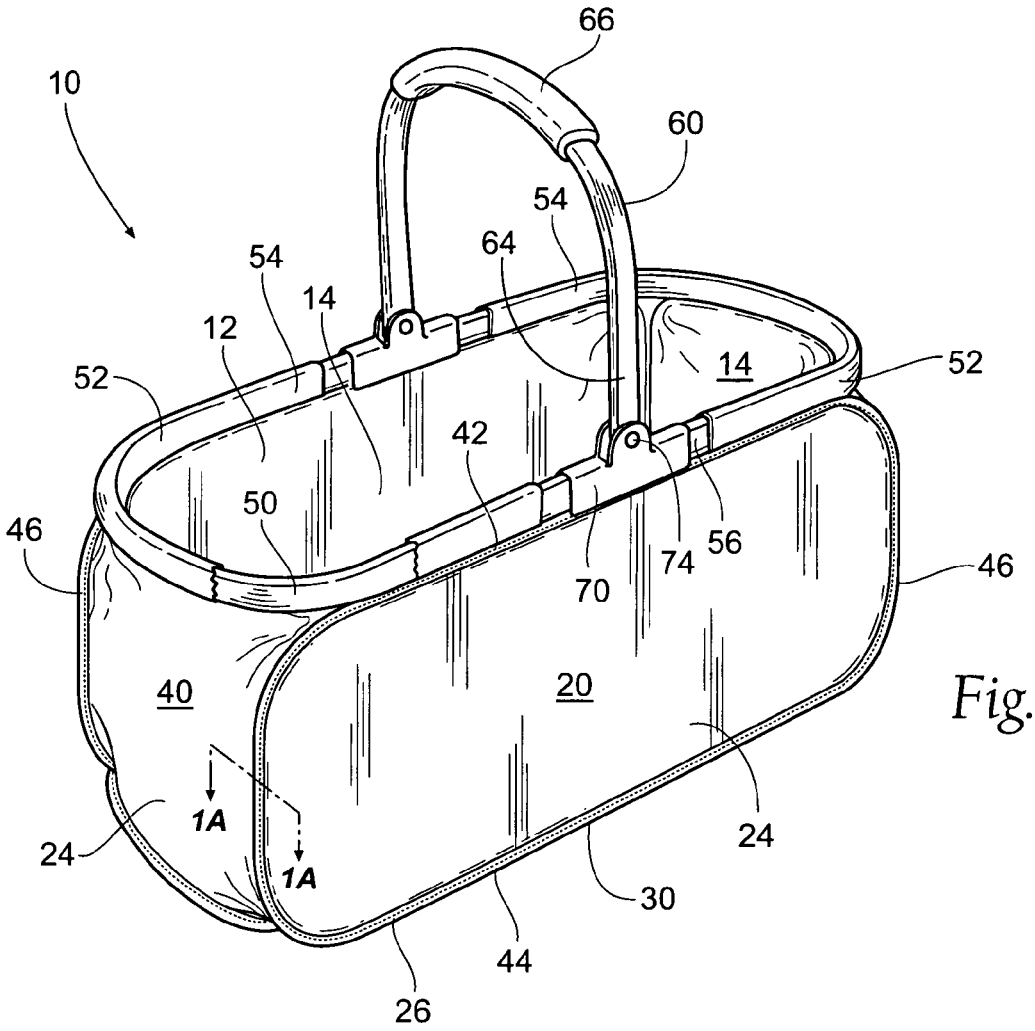
FIG. 1 is a perspective view of an embodiment of the present invention, with partially cut-away portion.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

The present invention, a collapsible structure 10, is illustrated in the Figures. As seen particularly in FIGS. 1-3, an embodiment of the structure 10 comprises at least two opposed side panels 20, a floor panel 30, two opposed end panels 40, a rigid handle frame member 50, and an attached handle 60. The side panels 20, end panels 40, and floor panel 30 are connected to one another to form a substantially rectangular structure having an open top 12.

Figure 1A:
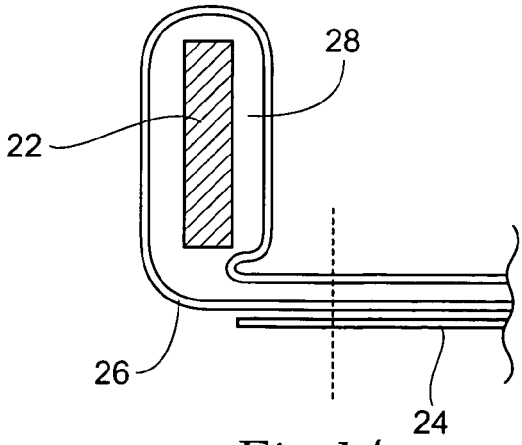
FIG. 1A is a cross sectional view of frame shown in FIG. 1, and taken along line 1A-1A thereof.
Figure 1B:
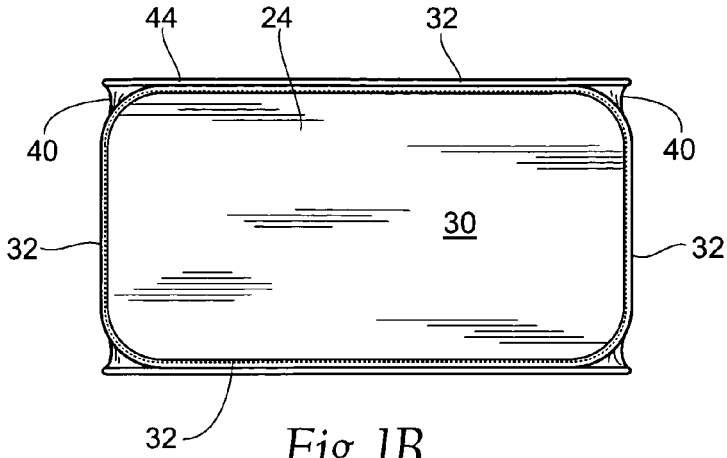
FIG. 1B is a bottom plan view of the device shown in FIG. 1.

Referring to FIGS. 1 and 1A, the two opposed side panels 20 and floor panel 30 further comprise a frame 22, a web 24, and an edging 26. The frame 22 is flexible and preferably formed from a sufficiently stiff yet resilient material such as spring steel wire or plastic, and is contained within the channel or pocket 28 formed by the edging 26. The frame 22 forms a continuous loop. Preferably, the frame 22 has a rectangular cross section, as shown in FIG. 1A, however a material having a differing cross section may be used. The web 24 is a flexible foldable material, such as nylon cloth or nylon mesh, but can be any suitably flexible material. The nylon, or other flexible material, may be solid or perforated. In construction, the perimeter of the web 24 is attached to the edging 26 by stitching 34 or other acceptable means, such that the edging 26 forms a pocket 28 about the periphery of the web 24 (see FIG. 1A). The edging 26 is a foldable, but stretch-resistant material capable of housing the frame 22 within its pocket 28.

As may further be observed, the opposed end panels 40 comprise a web 24 and an edging 26. The web 24 is a flexible foldable material, similar to that used for the mentioned side panels 20 and floor panel 30, however due to the collapsible nature of the container 10, opposed end panels 40 do not require the frame 22 which is present in opposed side panels 30. Construction of end panels 40 may be observed in FIGS. 1-3. As shown, the perimeter of the web 24 is stitched to the edging 26. The edging 26 is a foldable, but stretch-resistant material, similar to that mentioned in conjunction with the side panels 30 however since the ability to house a frame 22 is not required, the webs 24 may be attached to the edging 26 without the necessity of the previously discussed pocket structure 28. The web 24 and attached edging 26 have a shape configured to conform to the end panel 40 configuration required to complete a desired container 10.

Figure 2:
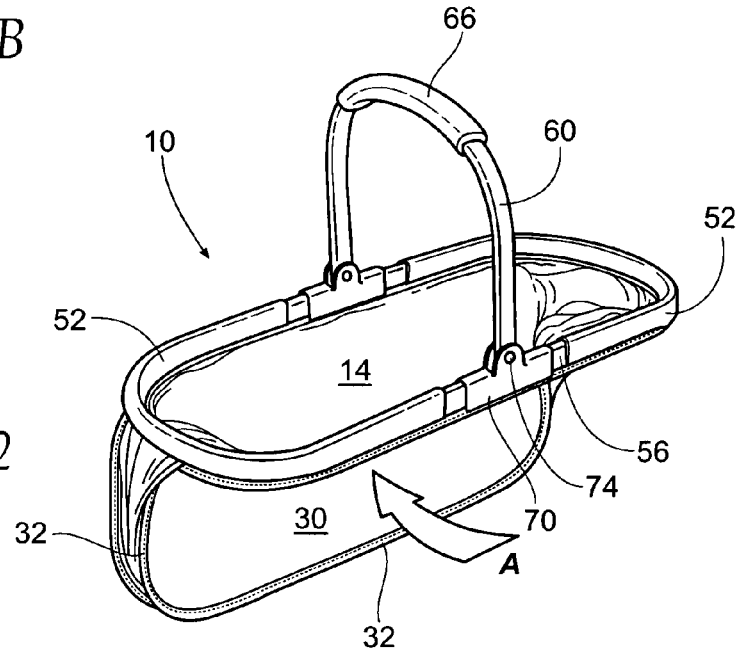
FIGS. 2 and 3 illustrate a method of collapsing the device shown in FIG. 1.
Figure 3:
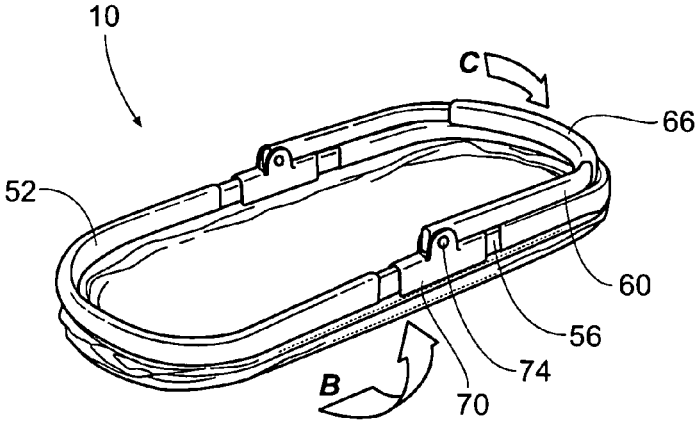
Figure 4:
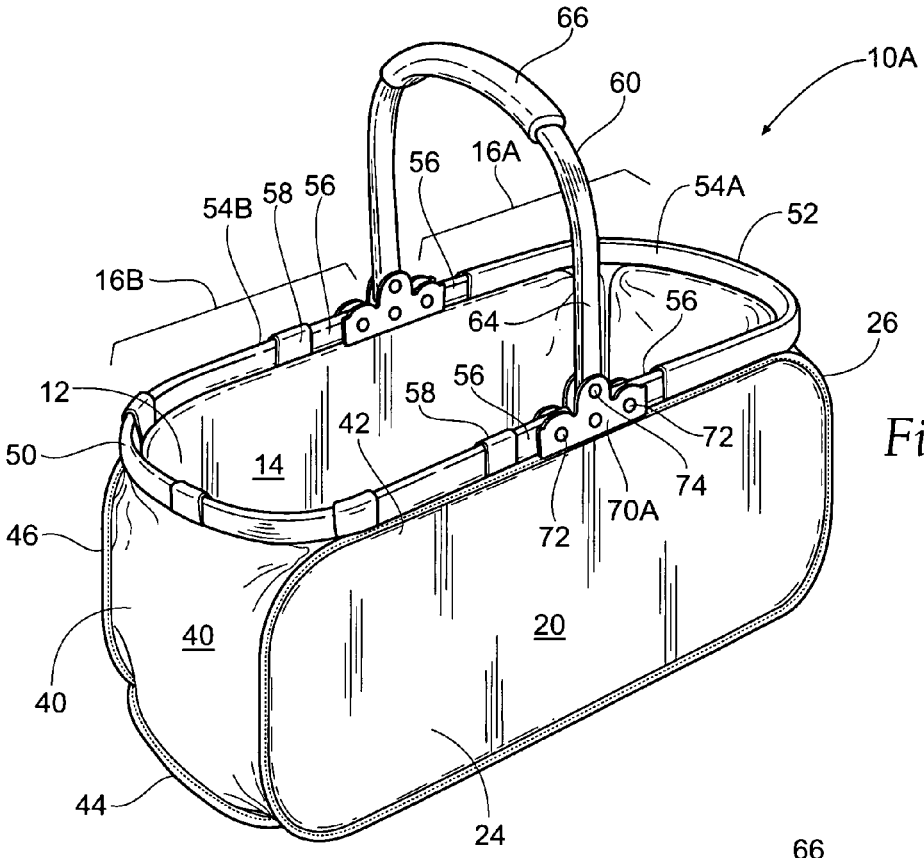
FIG. 4 is a perspective view of an embodiment of the present invention.

As seen in FIGS. 1-3, the floor panel 30 is also a foldable web 24 of material and has a generally rectangular shape. The floor panel 30 may further comprise a frame 22, a web 24, and an edging 26, with the edging 26 being attached to each side panel 20 and each end panel 40. The floor panel 30 provides means for holding the objects (not shown) within the structure 10, while the frame 22 supports the structure 10 in its expanded state.

As shown in FIG. 1, each side panel 20 and each end panel 40 includes a top side 42 corresponding to the open top 12 of the structure 10, a floor side 44 attached to one of the sides 32 of the floor panel 30, and two lateral sides 46 attached to adjacent lateral sides 46 of adjacent end panels 40 or side panels 20.

As may be further seen in FIGS. 1-3, a relatively rigid handle frame member 50 may be preferably attached to and encircle the open top periphery 12 of the container 10. As shown in FIGS. 1-3, the handle frame member 50 may be attached to the open top periphery 12 by of a handle frame edging material 52, which is adapted to envelope the handle frame member 50 therein. The handle frame edging material 52 may be coupled to the periphery of the open top 12 by way of stitching or other means. As seen, the handle frame member 50 preferably comprises a pair of U-shaped frame portions 54, each of which terminates in ends 56. Ends 56 are adapted to be received in a respective pivot connector 70. As may also be observed, a U-shaped handle member 60 may include ends 64, which are pivotally connected at pivot points 74 to a respective pivot connector 70. The handle member 60 is adapted to rotate between an upright, operable position, as seen in FIG. 1, and a horizontal storage position for use when the container 10 is collapsed (see FIG. 3). The handle member 60 is preferably formed from a relatively rigid material and may include padding 66 that extends along at least a portion of the handle member 60. The handle member 60 for the present invention is not limited to the particular type shown in FIGS. 1-3; however it is preferred for ease of use.

Although stitching is presented as the preferred means for attaching or connecting the elements of the structure 10 and permitting relatively convenient folding of the structure 10, it is to be understood that other methods of attachment can be used in this invention. Such other methods may include heat sealing, gluing and the like. Accordingly, construction of the collapsible structure should not be limited to stitching alone.

From the expanded state, the structure 10 may be folded into a collapsed state for storage and transportation. FIGS. 2 and 3 illustrate the various steps for collapsing the structure 10. Referring to FIG. 2, the first step requires pushing the floor panel 30, into the enclosure 14 in the direction of arrow A. The next step, as seen in FIG. 3, includes rotating an opposing side panel 20 of the structure 10, along with floor panel 30 upwardly in the direction of arrow B, to meet the handle frame member 50, until the opposed side panels 20, and floor panel 30 are adjacent to and overlay each other. The final step, shown in FIG. 3, is the pivoting of the handle member 60 in the direction of arrow C from an upright position to a position adjacent the handle frame member 50. The resulting collapsed structure 10 is a stack of two side panels 20 and the floor panel 30. When the collapsed structure 10 is required for use, the frame members 22 will bias the structure 10 into its fully expanded state, shown in FIG. 1.

Referring now to FIGS. 4-9, a preferred embodiment of the collapsible structure is shown as reference numeral 10A. As in the previous embodiment, the collapsible structure 10A includes at least a pair of opposed side panels 20, a pair of opposed end panels 40, a floor panel 30, a rigid handle frame member 50, and a pivotally attached handle 60. The side panels 20, end panels 40 and floor panel 30 are connected to one another to form a substantially rectangular collapsible structure having an open top 12.

As shown, each of the two opposed side panels 20 and floor panel 30 comprise a web 24, a frame 22, and an edging 26. As in the previous embodiment, the web 24 is a flexible foldable material, such as nylon cloth or nylon mesh, but any suitable material may be used. The material may be solid or perforated, as desired. An example of such material may also include durable material such as micro fiber polyester canvas which may or may not include a water resistant interior coating. The frame 22 is flexible, preferably formed from a sufficiently stiff yet resilient material such as spring steel wire or plastic, and similarly to the previously described embodiment, is contained within the channel or pocket 28 formed by the edging 26. The edging 26 is a foldable, but stretch-resistant material capable of housing the frame 22 within its pocket 28.

As may further be observed, the opposed end panels 40 comprise a web 24 and an edging 26. The web 24 is a flexible foldable material, similar to that used for the mentioned side panels 20 and floor panel 30, however due to the collapsible nature of the container, opposed end panels 40 do not require the frame 22 which is present in opposed side panels 20. Construction of opposed end panels 40, is similar to those shown FIGS. 1-3. The perimeter of the web 24 is stitched to the edging 26, with the edging 26 being a foldable, but stretch-resistant material, similar to that mentioned in conjunction with the opposed side panels 20. However, since the ability to house a frame 22 is not required, the webs 24 may be attached to the edging 26 without the necessity of the previously discussed pocket structure 28. The web 24 and attached edging 26 have a shape configured to conform to the end panel 40 configuration required to complete a desired container 10A.

As may be further observed, the floor panel 30 preferably comprises a frame 22, a web 24, and an edging 26, with the edging 26 being attached to each side panel 20 and each end panel 40, as will be further discussed. The floor panel 30 provides means for holding the objects (not shown) within the structure 10A, while the frame 22 supports the structure 10A in its expanded state.

As shown in the Figures, and similar to the previously described embodiment, each side panel 20 and each end panel 40 includes a top side 42 corresponding to the open top 12 of the structure 10A, a floor side 44 attached to one of the sides 32 of the floor panel 30, and two lateral sides 46 attached to adjacent lateral sides 46 of adjacent end panels 40 or side panels 30.

As may be further seen in FIGS. 4-9, a relatively rigid handle frame member 50 may be preferably attached to and encircle the open top 12 periphery of the container 10A. The handle frame member 50 shown in FIGS. 4-9 further comprises a pair of U-shaped frame portions 54A, 54B, each of which terminates in ends 56. Ends 56 are adapted to be pivotally received in a respective pivot connector 70A at pivot points 72. As shown in FIGS. 4-9, a first portion 16A of the open top periphery may be attached to frame member portion 54A by of a handle frame edging material 52, which envelopes the handle frame member portion 54A therein. As described regarding the embodiment shown in FIGS. 1-3, the handle frame edging material 52 may be coupled to a predetermined portion 16A of the open top 12 periphery by way of stitching or other means.

The device shown in FIGS. 4-9 also preferably includes means for releasable attachment of a second portion 54B of the handle frame member 50. As may be seen in the Figures, the container 10A may include a second portion 16B of the open top 12 periphery. The frame portion 54B is attached to the second portion 16B, by way of releasable attachment means, such as the releasable tab members 58 shown. The releasable tab members 58 may be formed from any flexible, releasable material, such as the hook and loop fabric illustrated, and may be coupled to the open top 12 at predetermined positions along the second portion 16B periphery. As may also be observed, the ends 56 of each U-shaped frame portion 54A, 54B are adapted for pivotal attachment to a respective pivot connector 70A. As shown, the pivot connector 70A includes a plurality of pivot points 72, 74, with pivot points 72 adapted to pivotally receive respective ends 56 of frame potion 54A, 54B. As seen, the handle member 60 further includes ends 64, which are pivotally connected to a respective pivot connector 70A at pivot points 74. As shown, the handle member 60 is formed from a relatively rigid material and may include padding 66 that extends along at least a portion of the handle member 60. It is to be understood that the handle member 60 of the type used for the present invention is not limited to the particular type shown in the Figures, however it is preferred for ease of use.

As discussed in reference to the described embodiments shown in FIGS. 1-3, the structure 10A illustrated in FIGS. 4-9 may, from the expanded state, be folded into a collapsed state for storage and transportation. FIGS. 1-3 show various steps for collapsing the previously described structure 10, and the structure 10A illustrated in FIGS. 4-9 is similarly collapsed (see specifically FIGS. 5-9).

Figure 5:
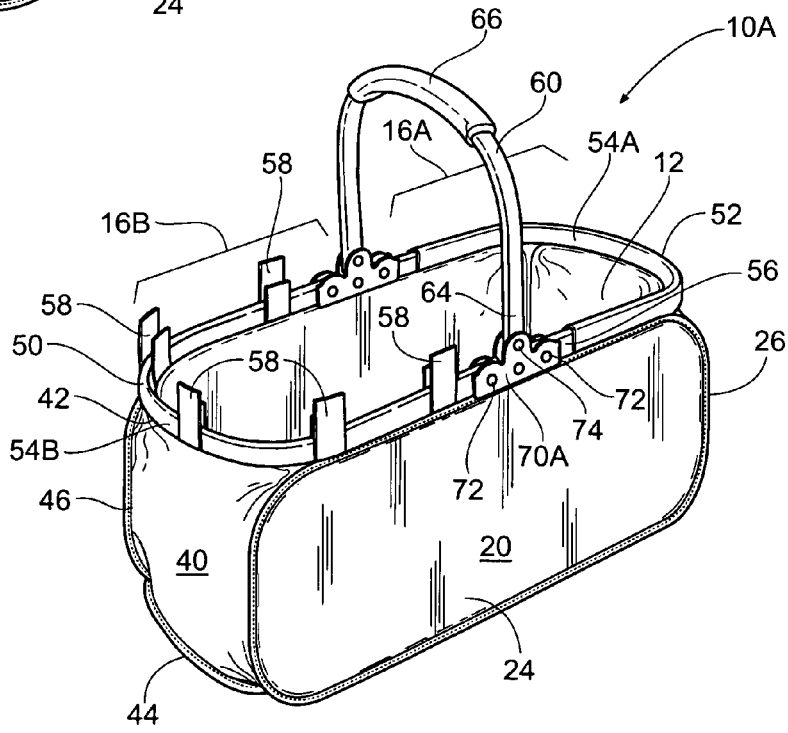
FIGS. 5-9 illustrate a method of collapsing the device shown in FIG. 4.
Figure 6:
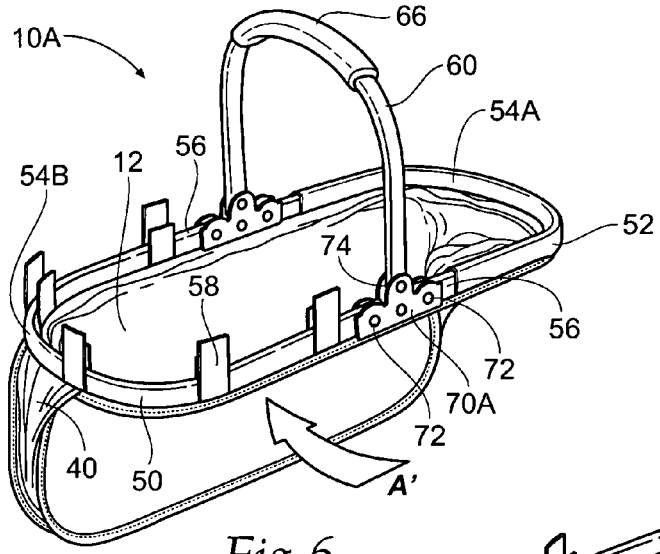
Figure 7:
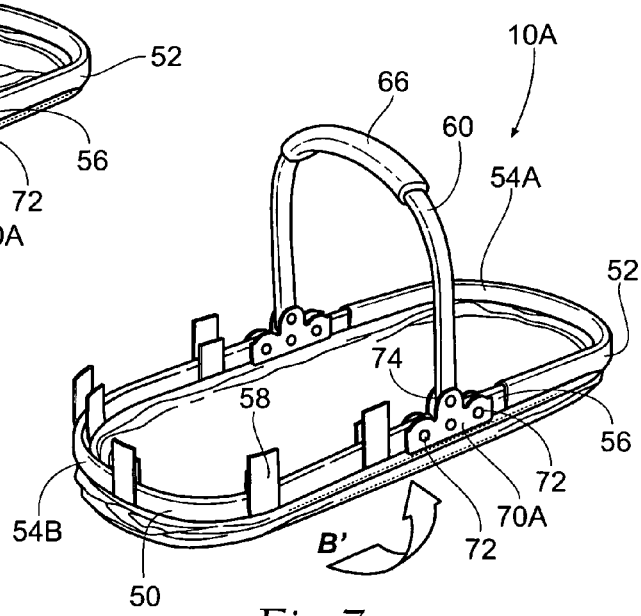
Figure 8:
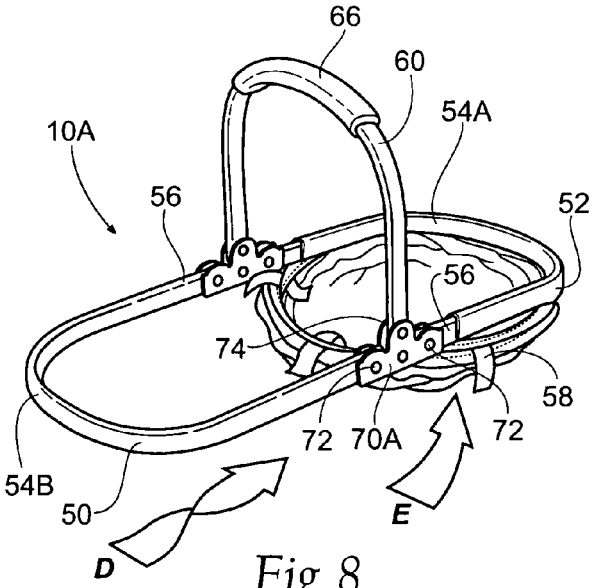

The first step may be observed in FIG. 5. As shown, the releasable tab members 58 are opened and portion 54B is thereby disengaged from the open top portion 16B. Referring now to FIG. 6, and similarly to FIG. 2, the next step requires pushing the floor panel 30 into the enclosure 14 in the direction of arrow A'. Next, and as seen in FIG. 7, opposite side panels 20 of the structure 10A are biased, along with floor panel 30, upwardly in the direction of arrow B', to meet the handle frame member 50, until the opposed side panels 20, and floor panel 30 are adjacent to and overlay each other. The resulting collapsed structure 10A is a stack of two side panels 20 and the floor panel 30. FIG. 8 illustrates the next step of rotating the released portion of the partially collapsed structure 10A in the direction of arrow D. The structure 10A will first twist and then will rotate in the direction of arrow E to form overlaying circular loops situated adjacently as shown in FIG. 8.

Figure 9:
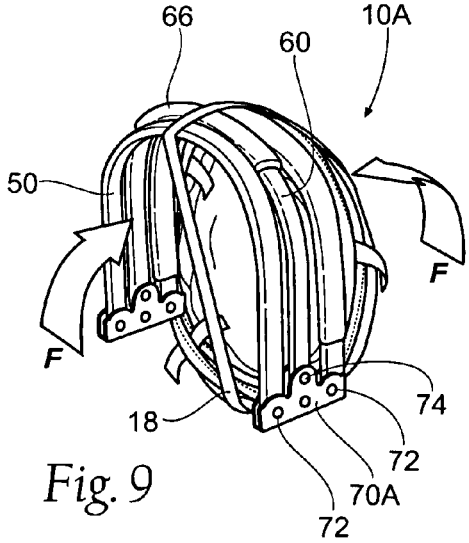

The final steps, shown in FIG. 9, include pivoting each handle frame portion 54A, 54B of the handle frame member 50 in the direction of arrows F from an extended position to a position adjacent the handle member 60. Also shown in FIG. 9, is the optional step of encircling the collapsed structure 10A, by a retaining strap 18, if provided for finally securing the structure 10A in the collapsed state.

When the retaining strap 18 is removed from around the collapsed structure 10A the handle frame member portions 54A, 54B are pivoted back to the horizontal position. The frames 22 will then bias the structure 10A into its fully expanded state.

Figure 10:
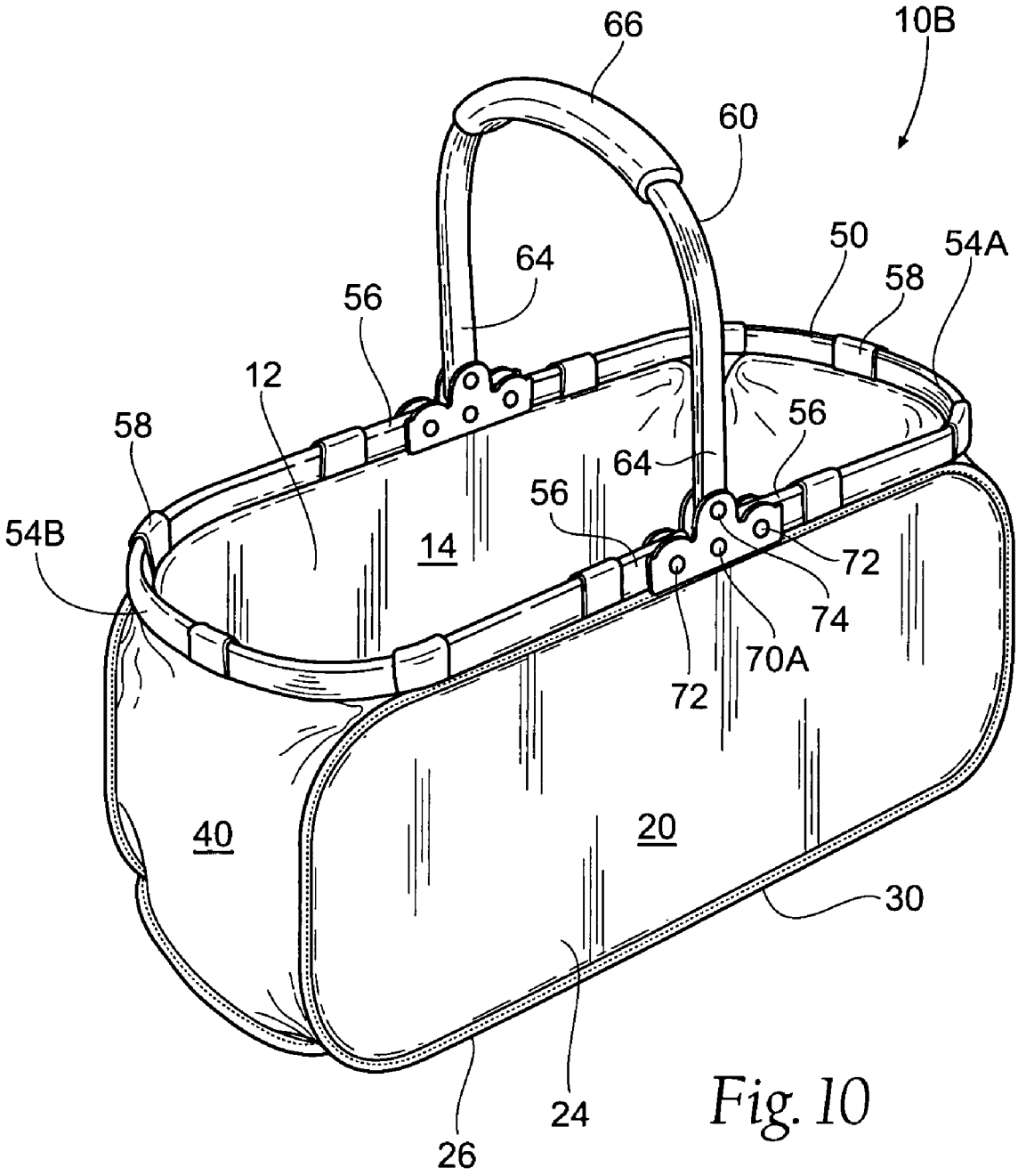
FIG. 10 is a perspective view of another embodiment of the present invention.

FIG. 10 illustrates an embodiment of a container 10B, similar to those described in relation to FIGS. 4-9, but showing a handle frame member 50 attached to the periphery of the open top 12 entirely by way of releasable attachment means. As seen, the device 10B shown in FIG. 10 includes means for releasable attachment of both a first and a second portion 54A, 54B of the handle frame member 50. Such means may include the releasable tab members 58 shown. The releasable tab members 58 may be formed from any flexible, releasable material, such as the hook and loop fabric illustrated, and may be coupled to the open top 12 at predetermined positions along the periphery.

Turning now to FIGS. 11-14 yet another alternative embodiment is illustrated. As seen, the structure 100 may be in the form of an axially-compressible, curvilinear collapsible structure 100. A curvilinear web panel 102 comprises the generally cylindrical structure 100, which may be reduced in size through axial compression. While the illustrations depict a generally cylindrical shape, it is to be understood that the structure 100 may be of any curvilinear configuration. As illustrated particularly in FIG. 11, the collapsible structure 100 preferably includes a supporting frame 104 having a continuous coil body 106. As may be seen, the coil body 106 is axially-compressible, as represented by arrow G in FIG. 12, from an extended position having a first height H1 (see FIG. 11) to a collapsed position having a second height H2 (see FIG. 12), wherein the first height H1 is greater than the second height H2. In a preferred embodiment, the coil body 106 possesses a resilient memory that biases the body 106 in the extended position. The supporting frame 104 is preferably positioned within an edging 108 which envelops the frame 104 and is coupled to a surface of the web panel 102.

As in the previously described embodiments, and in accordance with an aspect of the invention, a relatively rigid handle member 60 and handle frame member 50 may be attached to the periphery of the open top 12 by way of handle frame edging material 52. As may be observed, the handle frame edging material 52 envelopes the handle frame member 50 and is attached to the periphery of the open top 12 such that the handle frame member 50 is attached to and encircles the open top 12 periphery. As is further shown, at least one handle member 60 may be pivotally coupled to the handle frame member 50 by way of pivot connector 70B.

Alternatively, and in a similar manner previously discussed with reference to FIGS. 6-10, the handle frame member 50 may be releasably attached to the periphery of the open top 12 by way of releasable tabs 58 or other suitable means. Releasable tabs 58, such as hook and loop fasteners (not shown in these views) may be attached to the periphery of the open top 12 at predetermined positions to thereby provide releasable attachment means for the handle frame member 50.

Figure 11:
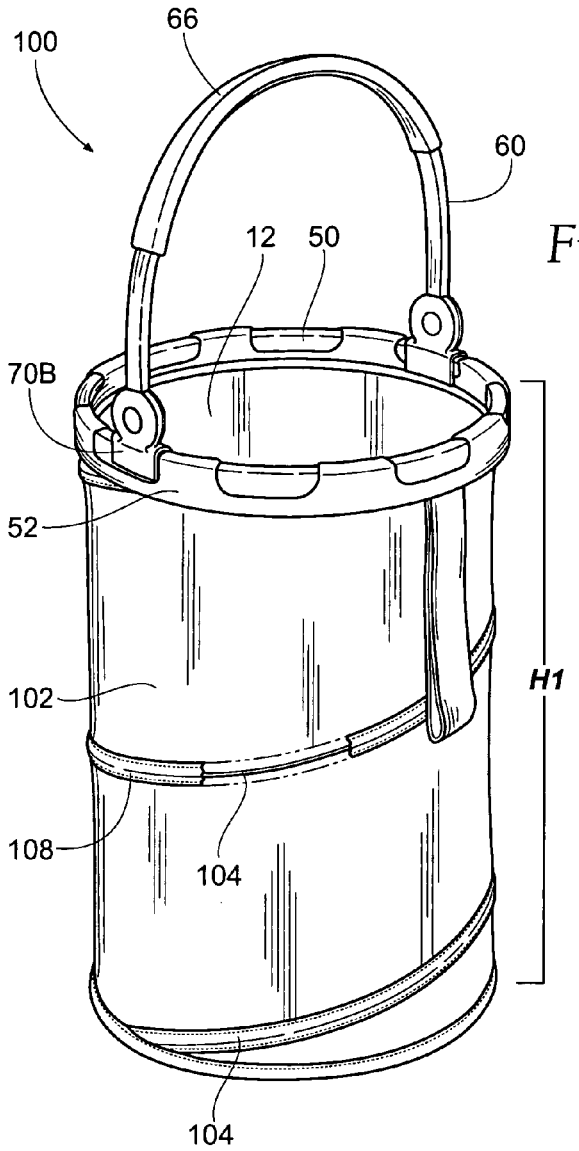
FIG. 11 is a perspective view of yet another embodiment of the present invention.
Figure 12:
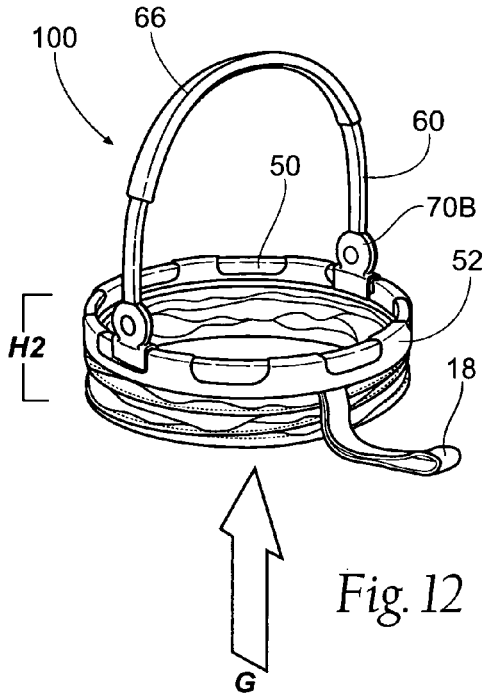
FIGS. 12 and 13 illustrate a method of collapsing the device shown in FIG. 11.
Figure 13:
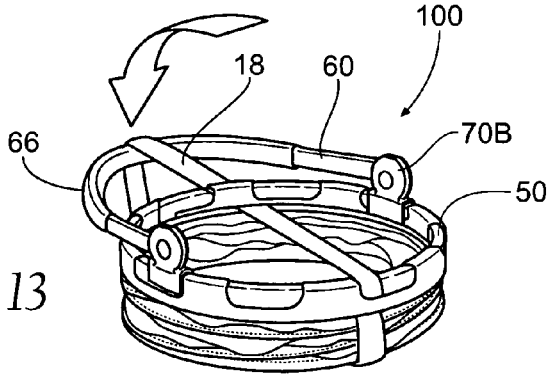

It is further contemplated that the container 100 illustrated in FIGS. 11-12 may have a handle frame member 50 that is attached to the open top using both handle frame edging 52 to envelop and retain a portion (not shown) of the handle frame member 50 to the open top 12, and a remaining portion (not shown) of the handle frame member 50 being releasably attached by way of the aforementioned releasable tabs (see FIG. 5, for example) or other acceptable means.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A collapsible structure having an open top, said structure comprising:

at least two opposed side panels, each side panel including a web having a perimeter, an edging attached to the perimeter of the web and forming a pocket about the periphery of said web, and a continuous loop frame;

said loop frame being positioned within said pocket;

each side panel having a bottom side and two lateral sides;

at least two opposed end panels, each end panel including a web having a perimeter and an edging attached to at least a portion of said perimeter, said opposed end panels having a bottom side and at least two lateral sides;

a floor panel having a plurality of sides, each of said floor panel sides being attached to one of the respective bottom sides of each said side panel and each end panel;

a handle frame member, said handle frame member being attached to and encircling at least a portion of said open top periphery;

a handle member, said handle member being pivotally attached to said handle frame member;

a pair of pivot connectors, each one of said pair of pivot connectors being secured to said open top periphery and having a plurality of pivot points;

wherein said handle frame member further comprises a first portion and a second portion, each respective portion including a curved portion and two pivot ends, wherein each of said pivot ends is adapted to be pivotally received in a respective pivot point of a respective pivot connector;

wherein said open top periphery includes a first periphery portion and wherein a second periphery portion and said first periphery portion is attached to said first portion of said handle frame member by way of a handle frame edging material, said handle frame edging material being adapted to envelope said first portion therein; and wherein said second periphery portion includes means for releasable attachment of said second portion of said handle frame member to said second periphery portion.

2. The collapsible structure of claim 1 wherein said handle frame member is attached to the open top periphery by way of a handle frame edging material, said handle frame edging material being adapted to envelope the handle frame member therein.

3. The collapsible structure of claim 2 wherein said handle frame edging material is coupled to the periphery of the open top by way of stitching.

4. The collapsible structure of claim 1 wherein said handle member includes a curved portion and two free ends, said one of said two free ends being adapted for pivotal connection to a respective one of said pair of pivot connectors.

5. The collapsible structure of claim 4 wherein said handle member is adapted to rotate between an upright, operable position and a horizontal, storage position.

6. The collapsible structure of claim 5 wherein said handle member further includes a padding material extending along at least a portion of said curved portion.

7. The collapsible structure of claim 1 wherein said handle frame edging material is coupled to said first periphery portion by way of stitching.

8. The collapsible structure of claim 1 wherein said means for releasable attachment comprises releasable tab members.

9. The collapsible structure of claim 8 wherein said releasable tab members are formed from a hook and loop fastener material.

10. The collapsible structure of claim 8 wherein said releasable tab members are located at predetermined positions along said open top periphery.

* * * * *